US006158259A

United States Patent [19]

Schmitz et al.

[11] Patent Number: 6,158,259

[45] Date of Patent: Dec. 12, 2000

[54] LOCK CYLINDER

[75] Inventors: Martin Schmitz, Cologne; Harald Ruprecht, Erftstadt, both of Germany

[73] Assignee: Emhart Inc., Newark, Del.

[21] Appl. No.: 09/325,213

[22] Filed: Jun. 3, 1999

[30] Foreign Application Priority Data

Jun. 3, 1998 [DE] Germany ..... 198 24 713

[51] Int. Cl.[7] ..... E05B 47/00

[52] U.S. Cl. ..... 70/276; 70/278; 70/223; 70/472

[58] Field of Search ..... 70/276–278.3, 70/279–283, 221–224, 472, 278; 340/825.31

[56] References Cited

U.S. PATENT DOCUMENTS

| | | | |
|---|---|---|---|
| 3,376,615 | 4/1968 | Heckman | 70/276 X |
| 4,253,320 | 3/1981 | Schwab et al. | 70/276 |
| 4,576,025 | 3/1986 | Kassza et al. | 70/276 |
| 4,631,939 | 12/1986 | Herriott | 70/276 |
| 4,798,068 | 1/1989 | Nakauchi | 70/276 |
| 4,841,758 | 6/1989 | Ramblier | 70/276 |
| 4,848,115 | 7/1989 | Clarkson et al. | 70/276 |
| 5,083,122 | 1/1992 | Clark | 340/825.31 X |
| 5,092,148 | 3/1992 | Rong-Long | 70/278 |
| 5,094,093 | 3/1992 | Ben-Asher | 70/278 |
| 5,117,097 | 5/1992 | Kimura et al. | 70/278 |
| 5,373,718 | 12/1994 | Schwerdt et al. | 70/278 |
| 5,421,178 | 6/1995 | Hamel et al. | 70/283 |
| 5,544,507 | 8/1996 | Lin | 70/224 X |
| 5,628,217 | 5/1997 | Herrera | 70/279 |
| 5,694,798 | 12/1997 | Nunez et al. | 70/283 |
| 5,749,253 | 5/1998 | Glick et al. | 70/278 |
| 5,782,118 | 7/1998 | Chamberlain et al. | 70/279 |
| 5,791,178 | 7/1998 | Chamberlain et al. | 70/278 |
| 5,884,515 | 3/1999 | Milman | 70/276 X |
| 5,946,956 | 9/1999 | Hotzl | 70/276 |
| 5,960,656 | 10/1999 | Yao | 70/472 |
| 5,970,759 | 10/1999 | Trilk | 70/277 |
| 5,974,912 | 11/1999 | Cheng et al. | 70/223 X |
| 6,014,878 | 1/2000 | Shen | 70/472 |

FOREIGN PATENT DOCUMENTS

| | | |
|---|---|---|
| 42 34 321 | 4/1994 | Germany . |
| 196 12 156 | 3/1996 | Germany . |

*Primary Examiner*—Suzanne Dino Barrett
*Attorney, Agent, or Firm*—Edward D. Murphy

[57] ABSTRACT

A lock cylinder having a housing (2) and mounted rotatably therein a lock member (4), and having a driving shaft (9) for driving the lock member (4) includes a central element (17) which in turn includes electrical conductors passing right through the driving shaft (9) and the lock member (4) in the form of an operative connection from one side of the cylinder to the other existing independently of operation of the lock member. The central element (17) in the form of a rigid body is connected non-rotatably at each end (17', 17") to a respective unit carrier (12, 18), especially for electronic units. The driving shaft (9) is arranged to be coupled via a coupling (K) with the lock member (4) in a position so that they rotate together.

21 Claims, 7 Drawing Sheets

1
2
3
4
4'
5
7
9
11
14
16
17
21'''
21
22
24
25
27
28

LOCK CYLINDER

BACKGROUND OF THE INVENTION

The invention relates to a lock cylinder having a housing and mounted rotatably therein a lock member, and having a driving shaft for driving the lock member.

A lock cylinder of the kind in question is known from DE 42 34 321 A1, the lock cylinder having an optical fibre led right through the driving shaft. An optical fibre branch directed transversely to the optical fibre leads at the end face of the driving shaft to an evaluation unit co-operating with a magnet coil. The optical fibre is rotatable together with the driving shaft.

SUMMARY OF THE INVENTION

The object on which the invention is based is to provide in a lock cylinder an opportunity for an operative connection from the outside with the lock member.

The problem is solved with a lock cylinder in which a central element passing right through the driving shaft and the lock member is provided, and is in the form of an operative connection from one side of the cylinder to the other existing independently of operation of the lock member.

As a result of this construction, a lock cylinder of the present invention is provided, in which an operative connection with the lock element is possible from the outside by means of the central element. The lock member can be driven at any time from one side of the cylinder. From the other side, mainly from the outer side of the door, the operative connection can be produced via the central element, namely by authorisation for operating the lock. If there is no authorisation for operating the lock, the lock member cannot be driven by means of the driving shaft. On the contrary, the operative connection from one to the other side of the cylinder must be made first via the central element. According to the invention, this central element encloses electrical conductors so that pulses generated on the outer side of the door are transferable to the other side of the cylinder and serve to produce the operative connection, so that the lock member can be driven from the outer side of the door. Advantageously, the central element in the form of a rigid body is connected non-rotatably at each end to a unit carrier, especially for electronic units. In this way, very short line connections can be made between the electronic units. It is possible for the central element to be non-rotatably associated with the cylinder housing. An alternative arrangement can be created by virtue of the central element, which engages through the cylinder housing and is freely rotatable therein and is fixedly connected to the driving shaft. In a development that is simpler in terms of manufacturing techniques, the driving shaft is arranged to be coupled via a coupling with the lock member in a position so that they rotate together. Here, the coupling is influenced by way of the central element fixedly connected to the driving shaft. An electromagnetic coupling is especially suitable. For that purpose, the central element carries an electromagnet for operating the coupling.

This can be effected from both sides of the lock cylinder, constructed as a double lock cylinder, for example by means of a turning knob on each side. According to the invention, the central element extends for the entire axial length of the double lock cylinder comprising two housing halves. The lock member is rotatably arranged between the housing halves. The double lock cylinder can have a customary commercial cross-sectional profile, so that it is suitable for fitting into standard mortise locks. To take account of different lengths of the double lock cylinder for adaptation to the thickness of the particular door, the central element is telescopically displaceable in an operating knob at the end of the cylinder housing. To produce the coupling connection, in order to be able to operate the lock from the outer side of the door, the coupling contains a pivotable magnet armature which takes up a radial coupling position with respect to the driving shaft when a coil located on the central element is supplied with current. The coupling can be accommodated in a space-saving manner and operates very effectively. In detail, the magnet armature is mounted in the manner of a rocker and can be brought with one rocker arm into coupling engagement with the driving shaft surrounding the central element. In this construction, the relevant components are able to nest into each other. This is also assisted by the fact that a coil of the coupling sits concentrically on the axis of the driving shaft. The magnet armature is then associated with a driven shaft surrounding the driving shaft and arranged non-rotatably with respect to the lock member. Furthermore, provision is made for the magnet armature to be mounted on a bearing collar of the driving shaft so as to slide in the circumferential direction. Despite rotation of the driving shaft, the rocker-type mounting of the magnet armature is therefore always maintained. In lock technology, it has proved advantageous for the driving shaft to have several coupling engagement openings distributed around its circumference. Only a partial angular rotation of the driving shaft is therefore needed to reach the coupling position, namely, after authorisation for operating the lock has been confirmed. If this is not given, when the coil is not energised the magnet armature is located as a result of spring support against a sleeve inner wall in a deflected position relative to the driving shaft. So that co-rotation of the lock member is effected principally from the inner side of the door always by means of the operating knob provided there, the driven shaft is connected to the lock member to ensure rotation by means of permanent claw coupling. Here, the central element is non-rotatably connected to a first operating knob on one side (the outside) and is freely rotatably connected to a second operating knob on the other side, this second operating knob being non-rotatably connected to the lock member. A cap-like construction of the second operating knob enables a unit carrier connected non-rotatably to the central element to be housed in this operating knob. The unit carrier serves for mounting of an electrical operating circuit, which can be activated by no-load rotation of the central element. For example, a reader unit can be activated by means of this no-load rotation via the first operating knob. The activation can be achieved advantageously by means of a magnetic switch moved past a magnet. If the operating knob is not turned, the magnetic switch is not activated and the reader unit is therefore not set in operation, which has the advantage of saving electricity. Once activated, the reader unit receives the pulses via an aerial, whilst the power supply is effected via a battery. It is possible to provide the battery either in the inside or outside operating knob. Preferably, however, it is housed in the operating knob on the inner side of the door. It is hence largely unaffected by climatic conditions and therefore has a greater number of locking cycles. Furthermore, vandalism and/or theft is prevented. Authorisation for operating the lock is preferably provided by way of a magnetically coded key, not illustrated, for example, in the form of a key card. Once the operating circuit has been activated through no-load turning of the central element by the operating knob on the outer side of the door, the corresponding pulses are supplied via the central element to the operating circuit arranged on the inner side of the door, which counteracts misuse from the outer side of the door.

BRIEF DESCRIPTION OF THE DRAWINGS

An exemplary embodiment of the invention is explained hereinafter with reference to the drawings, in which:

FIG. 7 is a perspective view of the driving shaft.

DETAILED DESCRIPTION OF THE PREFERRED EMBODIMENTS

Figure 1:
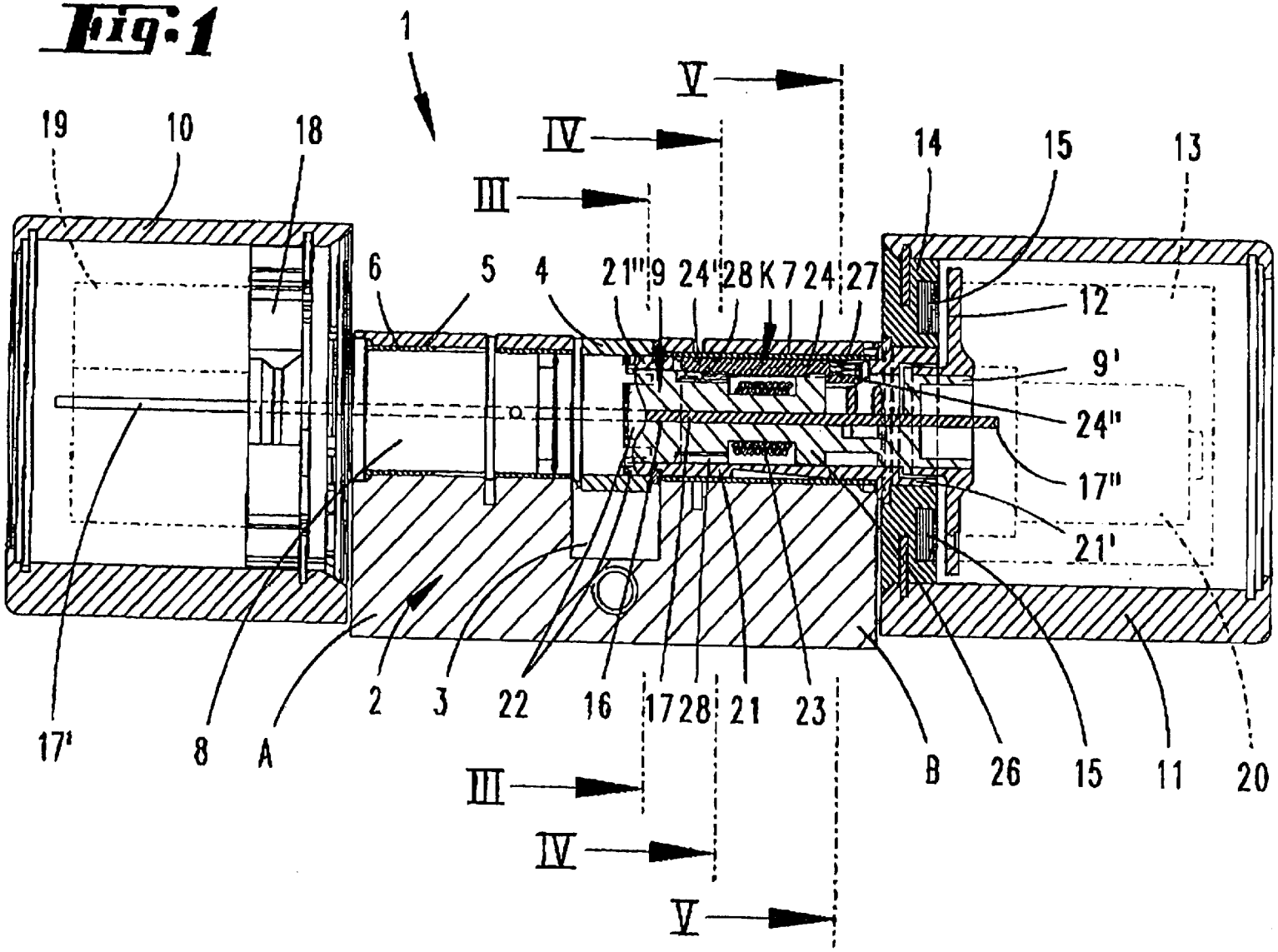
FIG. 1 is a longitudinal section through the lock cylinder with the magnet armature in its disengaged position relative to the driving shaft.
Figure 2:
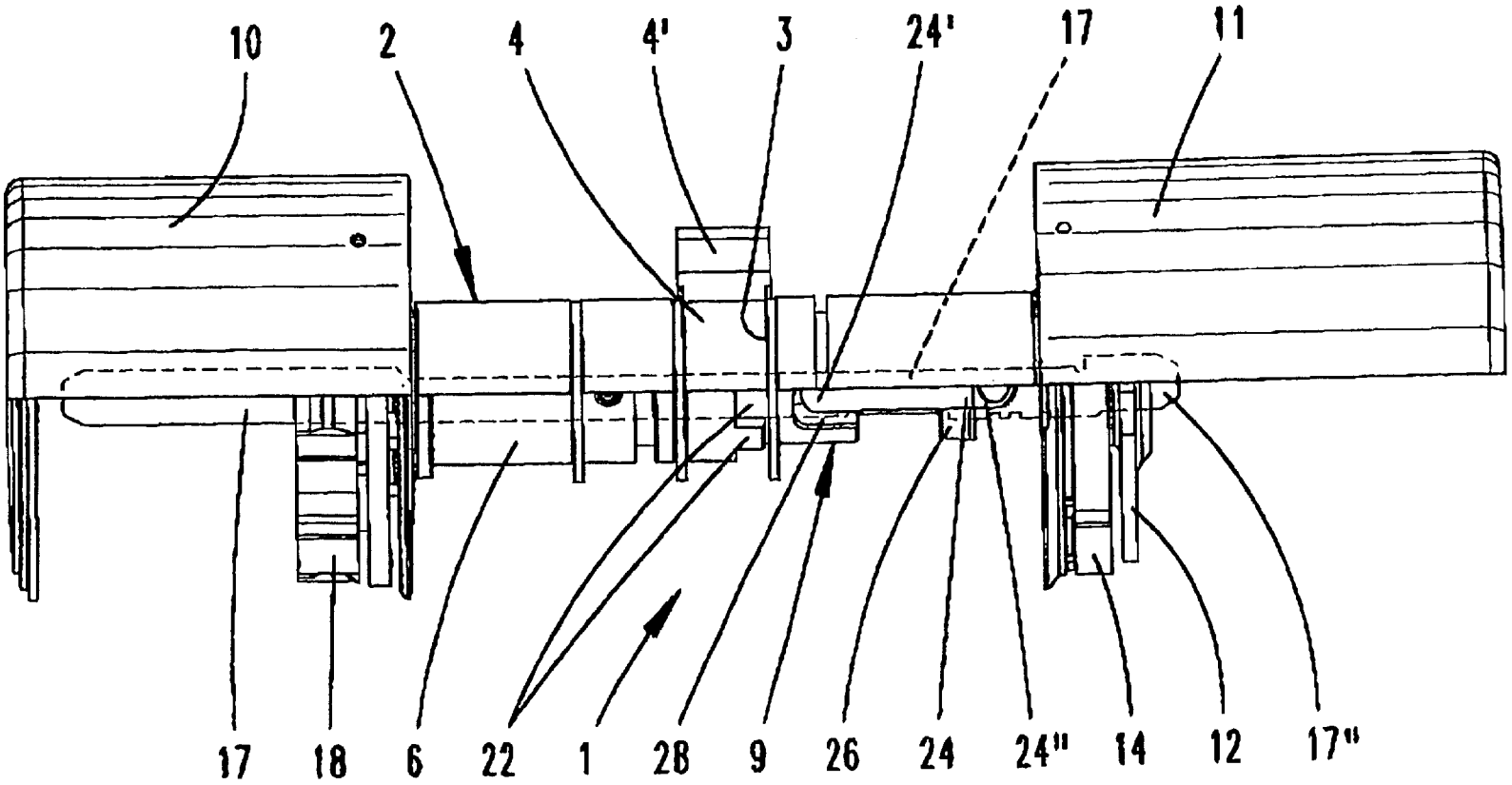
FIG. 2 is a plan view of the lock cylinder, with one half of the cylinder housing and of the operating knobs omitted.

The lock cylinder shown is denoted in its entirety by the reference number 1. It is in the form of a double profile lock cylinder, having a cylinder housing (2) which receives a lock member (4) in a central cut-out (3). The lock member (4) is provided with a radially outwardly directed locking projection 4'. The cylinder housing is divided by the cut-out (3) into two housing halves A and B.

In the region of the cylinder housing (2) of largely circular cylindrical cross-section, there is a bore (5) extending for the length of the cylinder housing (2), which bore receives a respective sleeve (6), (7) on each side of the cut-out (3). A bearing sleeve (8) is rotatably mounted in the one sleeve (6) of the housing half A, and surrounds a driving shaft (9) without relative rotation and is non-rotatably coupled thereto. One end thereof is non-rotatably connected at the end face of the housing half A to an operating knob (10). This operating knob is the first operating knob (10), which is accessible from the outer side of the door.

The other end of the driving shaft (9) engages through the lock member (4) and continues beyond the housing half B and projects into the inside of a cap-shaped second operating knob (11) arranged on the inner side of the door. Positioned non-rotatably on the free end (9') of the driving shaft (9) is a unit carrier (12), which in its turn carries an operating circuit (13) enclosed by the operating knob (11) and indicated by dot-dash lines. The driving shaft (9) with the unit carrier (12) fixed thereto is rotatable independently of the second operating knob (11). The cap opening of this knob facing the cylinder housing (2) is closed off by a carrier ring (14) locked to the cap wall, which carrier ring is fitted on its side facing the unit carrier (12) with magnets (15) arranged in a ring. The unit carrier (12) receives a magnetic switch, not illustrated, so that on no-load rotation of the driving shaft (9) the magnetic switch receives a pulse to activate the operating circuit (13).

The driving shaft (9) is provided with a longitudinal channel (16), one narrow side of which is open towards the circumference. The channel (16) serves to receive without relative rotation a rod-shaped central element (17), which extends for the entire axial length of the cylinder housing (2). Its one end (17') continues beyond a knob carrier (18) for the first operating knob (10). The operating knob (10) is non-rotatably connected by this knob carrier (18) to the driving shaft (9). Telescope-like displacement between the knob carrier (18) and the central element (17) is possible. The other end (17") also projects so that it is telescopically displaceable into the second operating knob (11). This measure provides an opportunity to compensate for different lengths of cylinder housing. The central element (17) contains electrical conductors, not illustrated. For the rest, the central element (17) is in the form of a rigid body, one end (17') of which is in rotary connection with the knob carrier (18). This knob carrier (18) serves also as unit carrier for electronic units. These can contain an aerial (19) indicated by a dot-dash line. The unit carrier (12) on the inside of the knob is used to mount a battery (20). A reader unit can be provided in the outside knob, namely the first operating knob (10), which receives its magnetic pulses from a key, for example, a magnetically coded key. Preferably, however, such a reader unit is associated with the operating circuit (13) housed in the inside operating knob (11), which largely prevents unauthorised interference from the outer side of the door. The other end (17')' of the central element (17) is non-rotatably associated via the driving shaft (9) with the unit carrier (12) mounted thereon.

The region of the driving shaft (9) lying within the housing half B is surrounded by a driven shaft (21). The portion (21)' of the driven shaft projecting beyond the end of the housing half B is non-rotatably connected to the carrier ring (14), so that a rotation of the second knob (11) leads to simultaneous rotation of the driven shaft (21). The portion (21')' lying opposite the portion (21') forms with counter-claws of the lock member (4) a permanent claw coupling (22). This means that operation of the second operating knob (11) lying on the inner side of the door always moves the lock member (4) simultaneously. To be able to effect the drive from the outer side of the door by means of the first operating knob (10), the drive shaft (9) is arranged to be coupled with the lock member (4) in a co-rotation position by means of a coupling K. For that purpose, the central element (17), or the driving shaft (9) surrounding it for part of its length, carries an electromagnet. This contains a coil (23) arranged concentrically on the axis of the drive shaft (9), which coil is rotatable with the central element (17) and the drive shaft (9). Furthermore, the electromagnet contains a pivotable magnet armature (24), which enters the radial coupling position relative to the driving shaft when the coil is supplied with current. The magnet armature (24) is rocker-mounted, and its rocker arm (24') directed towards the lock member (4) can be brought into coupled connection with respect to the driving shaft (9). The magnet armature (24) in its turn is associated non-rotatably with the driven shaft (21). This is effected by a radial slot (25) in the driven shaft, in which the magnet armature (24) lies with a positive fit. The rocker mounting of the magnet armature (24) is provided by a bearing collar (26) of the driving shaft (9), so that the magnet armature is mounted on the bearing collar (26) so as to slide in the circumferential direction. When the coil (23) is not energised, that is, is not supplied with current, the rocker arm (24') is supported against the inner wall of the sleeve (7) by spring loading, see FIG. 1. A compression spring (27) associated with the other rocker arm (24')' and bearing against the inner wall of the sleeve (7) serves for the spring support.

Figures 3, 4, 5:
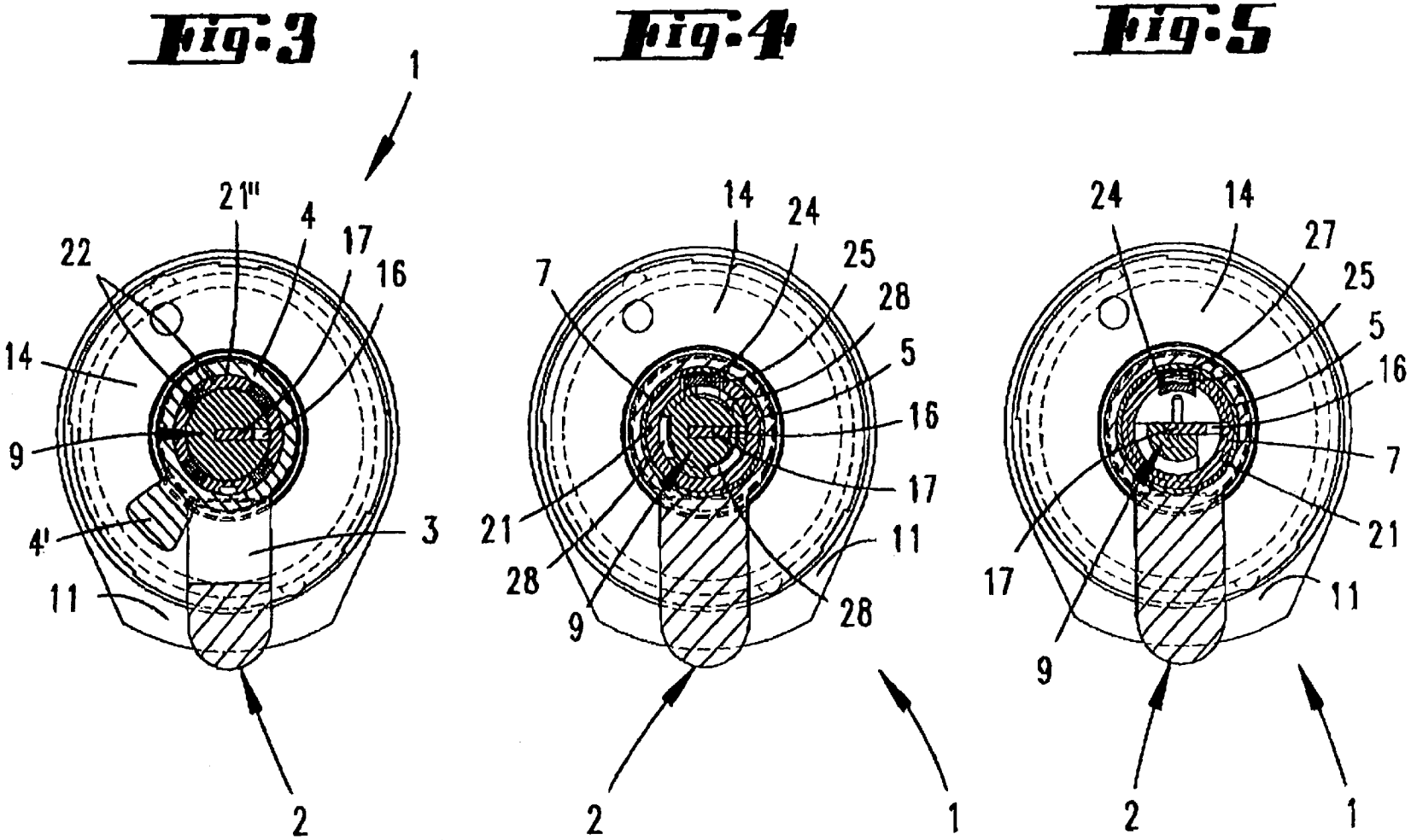
FIG. 3 is the section along the line III—III in FIG. 1.
FIG. 4 is the section along the line IV—IV in FIG. 1.
FIG. 5 is the section along the line V—V in FIG. 1.
Figure 6:
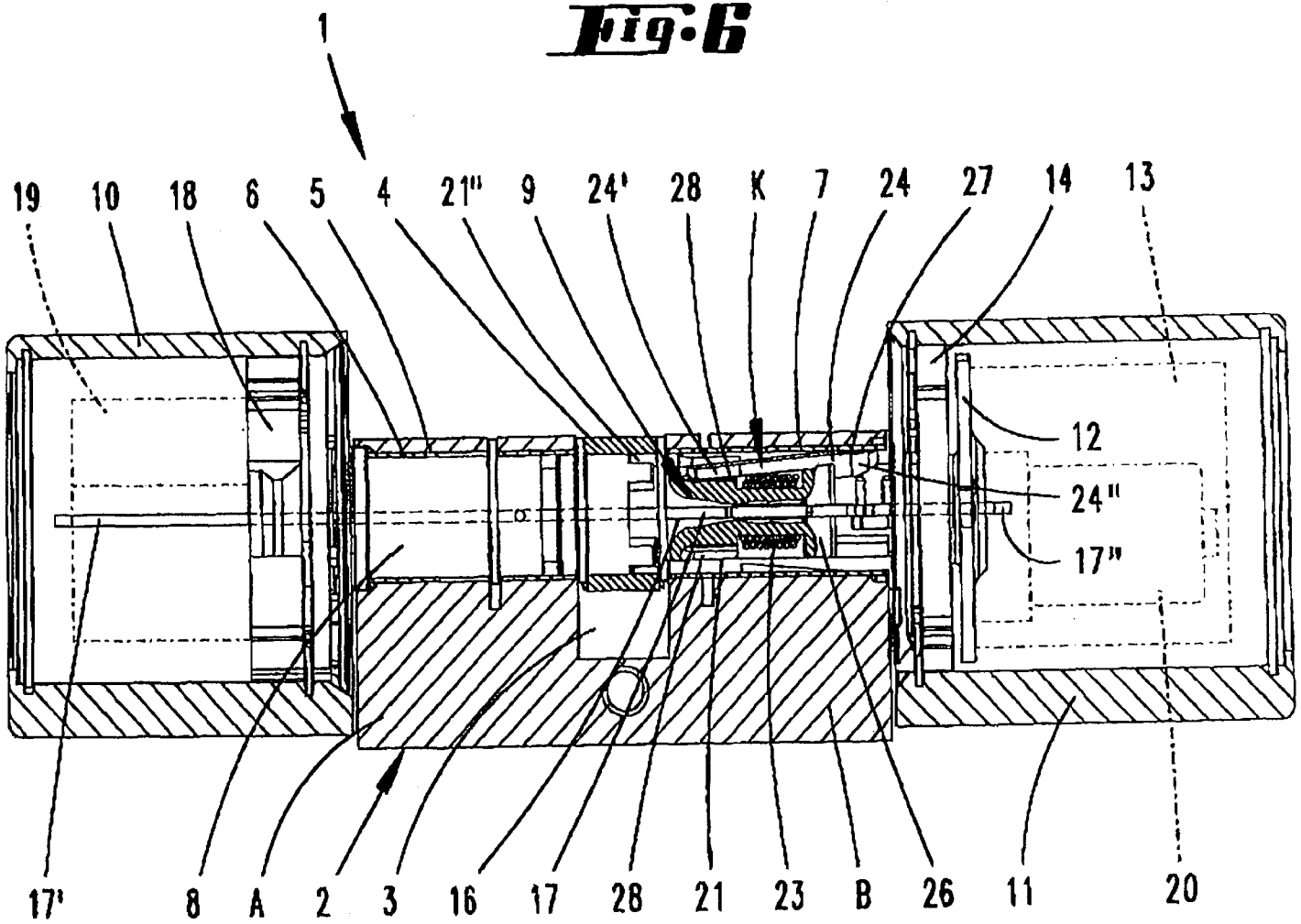
FIG. 6 is a view similar to FIG. 1, but in the coupled position of the magnet armature relative to the driving shaft.
Figure 6:
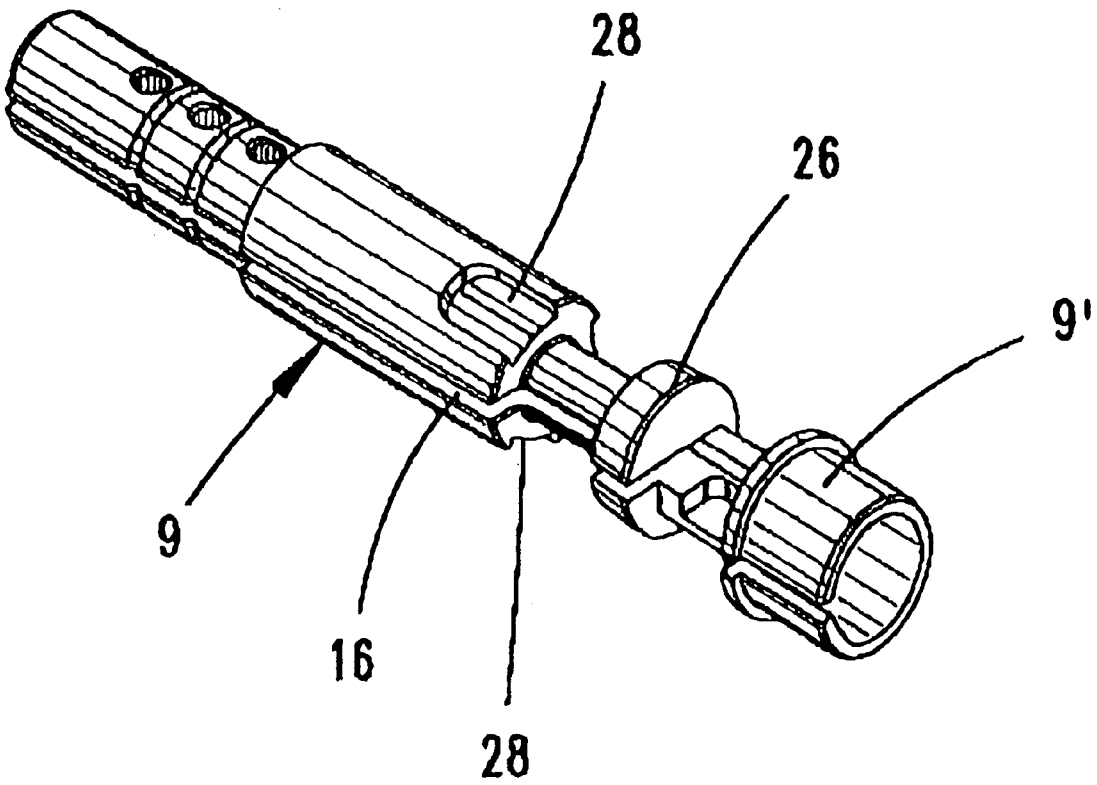
Figure 8:
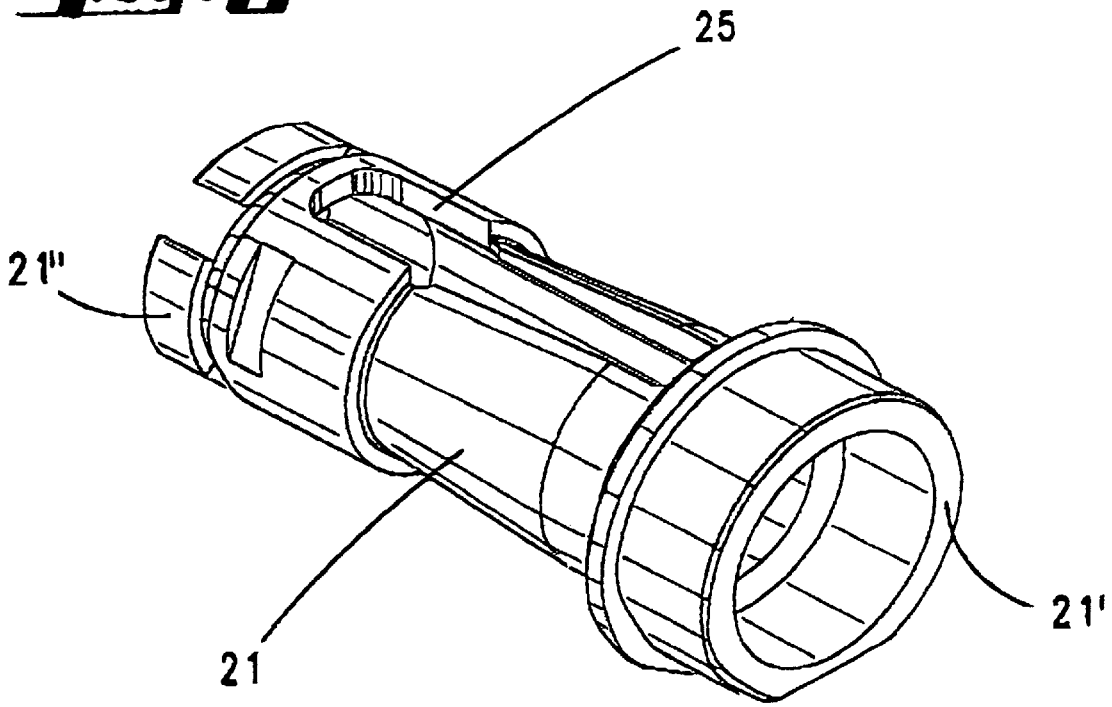
FIG. 8 is a perspective view of the driven shaft.
Figure 9:
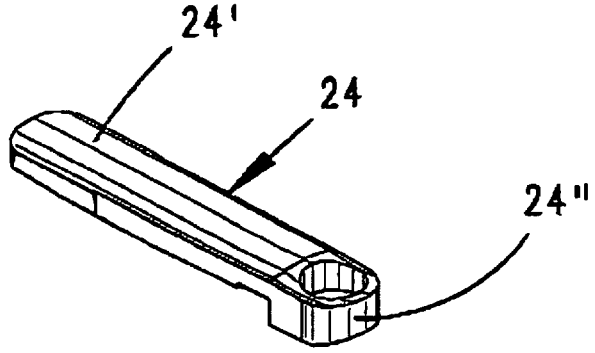
FIG. 9 is a perspective view of the magnet armature.
Figure 10:
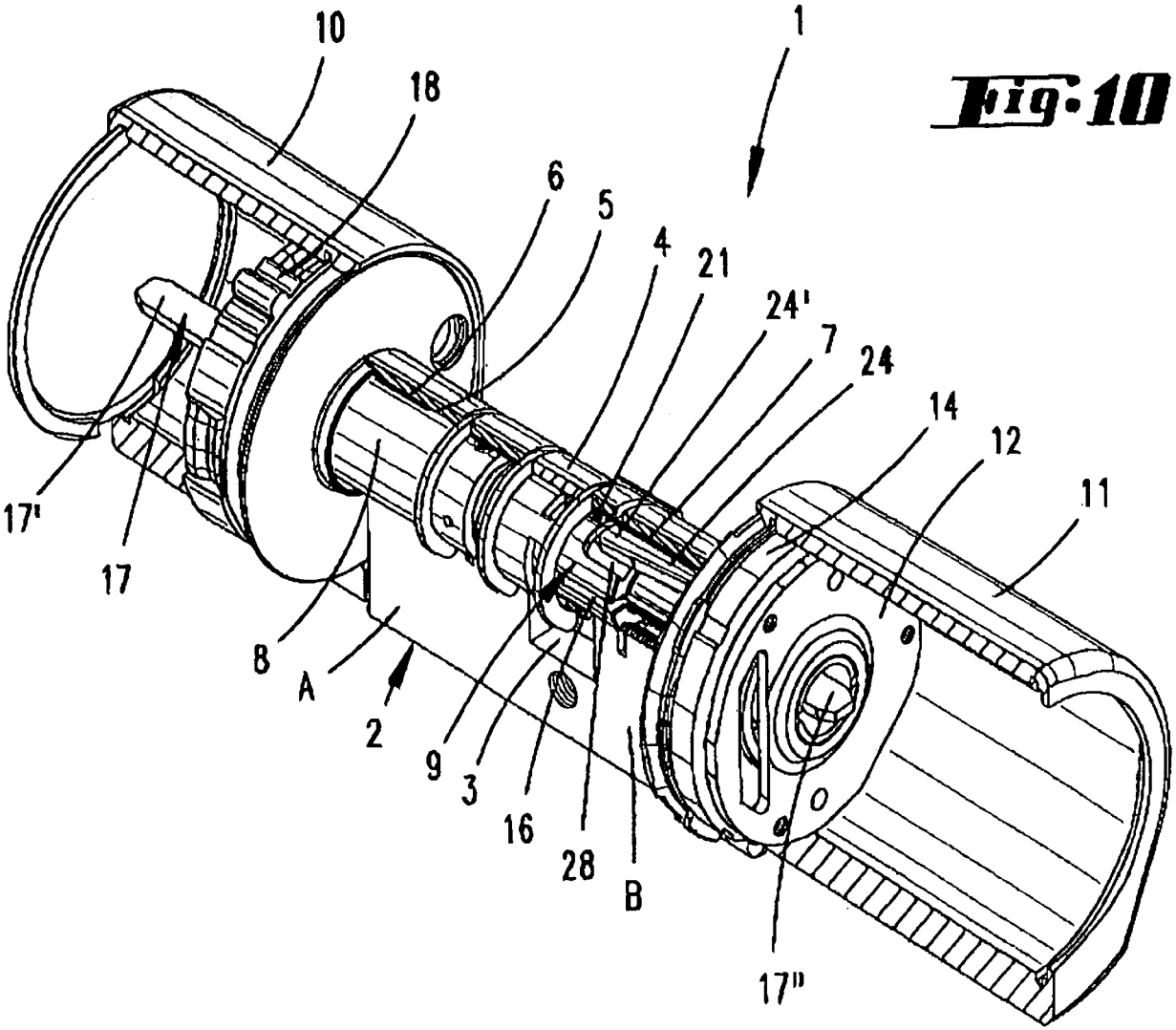
FIG. 10 is a perspective view of the lock cylinder shown partially broken open.

Associated with the rocker arm (24') are coupling engagement openings (28) distributed around the circumference of the driving shaft (9). In the embodiment, three such coupling engagement openings (28) are provided on the driving shaft (9). When no key is being used at the outside operating knob (10), the position of the magnet armature (24) is as shown in FIGS. 1 and 4. Although the driving shaft (9) can be rotated with the central element (17) by means of the first operating knob (10), there is no co-rotating connection with the lock member. Actuation of the lock from the outer side of the door requires for the time being a no-load rotation of the first operating knob (10). This involves positive co-rotation of the driving shaft (9) and the central element (17) passing through it. The magnetic switch, not illustrated, provided on the unit carrier is consequently moved past the magnet (15) to activate the operating circuit (13). By means of the key card brought into effect at the first operating knob (10), the aerial (19) is initiated. The corresponding pulses are supplied via the electrical conductors of the central element (17) to the operating circuit (13). If the authenticity of the magnetically coded key is recognised as correct by a memory in the operating circuit (13), the coil (23) is energised, which causes the magnet armature (24) to pivot against spring loading so that the rocker arm (24'), if a coupling engagement opening (28) lies opposite it, enters this. If there is a rotational offset between rocker arm (24') and coupling engagement opening (28), engagement is effected after a slight rotation of the drive shaft (9) by means of the outer operating knob (10), until the rocker arm (24') and a coupling engagement opening (28) are aligned opposite one another. The drive shaft (9) is then coupled with the driven shaft (21) via the magnet armature (24), the driven shaft in turn being connected co- rotatably with the lock member (4). Simultaneously with a co-rotation of the driven shaft (21), a co-rotation of the operating knob (11) on the inner side of the door is effected.

Alternatively, it would be possible to construct the lock cylinder as a half cylinder or double cylinder with just one knob for special functions. To that end, the carrier ring (14) can open into a fixed housing or be fixedly connected thereto.

Then there is the option of operating the lock on both sides only by authorisation. This can achieved, for example, in that the knob associated with the housing half B is connected directly to the unit carrier (12).

What is claimed is:

1. A lock cylinder comprising:

a housing having a lock member rotatably mounted therein;

a driving shaft for selectively driving the lock member;

a coupling having a pivot member supported in the housing which is positionable to take up a radial coupling position with respect to the driving shaft such that the pivot member couples the driving shaft to the lock member for co-rotation; and a central element extending through the driving shaft and the lock member, the central element being operatively connected between an outer side and an inner side of the lock cylinder independent of operation of the lock member, the central element further being operatively connected to the coupling for positioning the pivot member in the radial coupling position.

2. A lock cylinder according to claim 1, wherein the central element encloses electrical conductors.

3. A lock cylinder according to claim 2, wherein the central element is in the form of a rigid body connected non-rotatably at each end thereof to a respective unit carrier, especially for electronic units.

4. A lock cylinder according to claim 3, wherein the central element engages through the cylinder housing and is freely rotatable therein and is fixedly connected to the driving shaft.

5. A lock cylinder according to claim 1, wherein the central element carries an electromagnet for operating the coupling.

6. A lock cylinder according to claim 1, wherein the lock cylinder is in the form of a double lock cylinder, and carries a turning knob at each end.

7. A lock cylinder according to claim 6, wherein the central element extends for the entire axial length of the double lock cylinder, which comprises two housing halves.

8. A lock cylinder according to claim 7 wherein the central element is inserted so as to be telescopically displaceable in an operating knob at the end of the cylinder housing.

9. A lock cylinder according to claim 5, wherein the pivotal member comprises a pivotable magnet armature which takes up the radial coupling position with respect to the driving shaft when a coil located on the central element is supplied with current.

10. A lock cylinder according to claim 9, wherein the magnet armature is mounted in the manner of a rocker and is arranged to be brought with one rocker arm into coupling engagement with the driving shaft, the driving shaft surrounding the central element.

11. A lock cylinder according to claim 10, wherein a coil of the coupling is concentric with the axis of the driving shaft.

12. A lock cylinder according to claim 11, wherein the magnet armature is operatively associated with a driven shaft surrounding the driving shaft and arranged non-rotatably with respect to the lock member.

13. A lock cylinder according to claim 12, wherein the magnet armature is mounted on a bearing collar of the driving shaft so as to slide in the circumferential direction.

14. A lock cylinder according to claim 13, wherein the driving shaft defines a circumference having a plurality of coupling engagement openings distributed therearound.

15. A lock cylinder according to claim 14, wherein, when the coil is not energised, the magnet armature is biased against a sleeve inner wall in a deflected position relative to the driving shaft.

16. A lock cylinder according to claim 15 further comprising a permanent claw coupling interconnecting the driven shaft and the lock member.

17. A lock cylinder according to claim 1, wherein, on the outside of the lock cylinder, the central element is non-rotatably connected to a first operating knob, and is freely rotatably connected to a second, inner operating knob on the other side, the second operating knob being non-rotatably connected to the lock member.

18. A lock cylinder according to claim 17, wherein a unit carrier is arranged in the second, inner operating knob and is connected non-rotatably to the central element.

19. A lock cylinder according to claim 18, wherein the inner unit carrier carries an electrical operating circuit, which can be activated by no-load rotation of the central element.

20. A lock cylinder according to claim 19, wherein the activation is effected by means of a magnetic switch moved past a magnet.

21. A lock cylinder according to claim 20, wherein the first turning knob carries an aerial.

* * * * *